US009896303B2

(12) United States Patent
Freeman et al.

(10) Patent No.: US 9,896,303 B2
(45) Date of Patent: Feb. 20, 2018

(54) METHOD FOR CONTROLLING ELEVATOR CARS

(71) Applicant: ThyssenKrupp Elevator Corporation, Altanta, GA (US)

(72) Inventors: Mark Freeman, Collierville, TN (US); Jennifer L. Gordon, Cumming, GA (US); Fabio Speggiorin, Collierville, TN (US)

(73) Assignee: ThyssenKrupp Elevator Corporation, Atlanta, GA (US)

( * ) Notice: Subject to any disclaimer, the term of this patent is extended or adjusted under 35 U.S.C. 154(b) by 535 days.

(21) Appl. No.: 14/565,548

(22) Filed: Dec. 10, 2014

(65) Prior Publication Data

US 2016/0167920 A1 Jun. 16, 2016

(51) Int. Cl.
*B66B 1/20* (2006.01)
*B66B 1/24* (2006.01)

(52) U.S. Cl.
CPC ..... *B66B 1/2458* (2013.01); *B66B 2201/103* (2013.01); *B66B 2201/211* (2013.01); *B66B 2201/214* (2013.01); *B66B 2201/303* (2013.01)

(58) Field of Classification Search
CPC ..... B66B 1/2458; B66B 2201/103; B66B 2201/211; B66B 2201/214; B66B 2201/303
USPC ..... 187/247, 249, 380–388, 391, 393, 901, 187/902, 392
See application file for complete search history.

(56) References Cited

U.S. PATENT DOCUMENTS 4,341,288 A * 7/1982 Bass ..... B66B 1/14 187/384
4,895,223 A * 1/1990 Ekholm ..... B66B 1/2408 187/382
5,454,448 A * 10/1995 Bittar ..... B66B 1/462 187/384
5,865,274 A * 2/1999 Kiji ..... B66B 1/2458 187/249
6,328,135 B1 * 12/2001 Sirag, Jr. ..... B66B 1/2458 187/382
6,481,536 B2 * 11/2002 Pfeffer ..... B66B 1/18 187/247
6,601,678 B2 * 8/2003 Kostka ..... B66B 1/18 187/383
6,672,429 B1 1/2004 Thurmond, III
6,808,049 B2 * 10/2004 Brand ..... B66B 1/2458 187/247
6,991,068 B2 1/2006 Silkonen et al.
(Continued)

*Primary Examiner* — Anthony Salata
(74) *Attorney, Agent, or Firm* — RMCK Law Group PLC

(57) ABSTRACT

A method for controlling elevator cars of an elevator system according to one example includes assigning free elevator cars of the elevator system to one of either general service or express priority service (EPS). A destination dispatch controller receives an express priority service (EPS) call. The EPS call can indicate a request for priority service from an EPS call originating location to an EPS call final destination. The controller can determine whether any active EPS assigned car can service the EPS call. A particular elevator car can be an active EPS car when the particular car is carrying out EPS service. When a specific active EPS car can service the EPS call, the controller assigns the specific EPS car to the EPS call. Upon completion of the EPS call, the controller unassigns the EPS car to a free car.

17 Claims, 5 Drawing Sheets

(56) References Cited

U.S. PATENT DOCUMENTS

| | | | | |
|---|---|---|---|---|
| 7,025,180 | B2 | 4/2006 | Wyss et al. | |
| 7,032,715 | B2 | 4/2006 | Smith et al. | |
| 7,487,861 | B2 | 2/2009 | LaBarre et al. | |
| 8,387,757 | B2 | 3/2013 | Christy et al. | |
| 8,397,873 | B2 | 3/2013 | Smith et al. | |
| 8,413,766 | B2 * | 4/2013 | Friedli | B66B 1/24 187/383 |
| 8,905,195 | B2 * | 12/2014 | Finschi | B66B 1/2458 187/249 |
| 2016/0376122 | A1 * | 12/2016 | Van Dijk | B66B 1/2466 187/247 |

* cited by examiner

METHOD FOR CONTROLLING ELEVATOR CARS

FIELD

The present disclosure relates generally to elevator systems having a plurality of elevator cars and more specifically to a method of assigning an elevator car from a group of free elevator cars to service a priority call made to a priority floor.

BACKGROUND

Elevators are used in multi-floor buildings to transport passengers to various floors throughout the building. It is common for multi-floor buildings to have multiple elevator cars running to accommodate all calls in an efficient manner. Often, large buildings can have floors purposed differently including various combinations of office spaces and residence floors for example. Many times, passengers destined to different floors would prefer not to ride with each other. In this regard, some floors can be configured for restricted access. In some examples, offices may wish to permit access only to employees of the office and their guests. Similarly, residence floors may wish to permit access only to residents and their guests. Moreover, passengers do not like to stop at an excessive number of floors en-route to their destination. It is desirable to provide an elevator system having expedited service to predetermined floors while maintaining traffic flow with the remaining elevator cars at optimum efficiencies.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A method for controlling elevator cars of an elevator system according to one example of the present disclosure includes assigning free elevator cars of the elevator system to one of either general service or express priority service (EPS). A free elevator car is one that is not presently assigned to answer or respond to any particular type of service call, including a general service or EPS call, and is otherwise available to be called upon for service and may be assigned to any floor of the elevator system. Upon completion of a service call by either an EPS or general service assigned elevator car, if the elevator car is not immediately dispatched to respond to another service call, it becomes unassigned and a free car awaiting its next service call. In one aspect of the present disclosure, a destination dispatch controller, hereinafter "controller", receives an EPS call. The EPS call can indicate a request for priority service from an EPS call originating location to an EPS call final destination. The controller can determine whether any active EPS car can service the EPS call. A particular elevator car can be an active EPS car when the particular car is carrying out EPS service. When a specific active EPS car can service the EPS call, the controller assigns the specific EPS car to the EPS call. Upon completion of the EPS call, if there are no other EPS or general service calls to service, the controller resets the status of the specific EPS car so that it is again designated as a free car. Any service call received by the controller that is not an EPS call is considered to be a general service call.

According to additional features, the controller can determine an estimated time of arrival (ETA) for each active EPS car for the EPS call. The ETA can comprise an estimated time required for an active EPS car to travel from a current location to the EPS call originating location. The controller can compare the ETA for each active EPS car to an ETA threshold. When the determined ETA for an active given EPS car is within the ETA threshold, the controller can assign that active EPS car to service the EPS call. According to another example, the controller can determine an estimated time to destination (ETD) for each active EPS car for the EPS call. The ETD can comprise a sum of an estimated overall time required for an active EPS car to travel (i) from a current location to the EPS call originating location and (ii) from the EPS call originating location to the EPS call final destination. The controller can compare the ETD for each active EPS car to an ETD threshold. When the determined ETD for a given active EPS car is within the ETD threshold, the controller can assign that active EPS car to service the EPS call.

According to other features, when no active EPS car can service the EPS call, the controller can determine whether a number of active EPS cars is below a car count threshold. When the number of active EPS cars is below the car count threshold, the controller can assign an additional car to service the EPS call. When the number of active EPS cars is not below the car count threshold, the controller can assign a best available active EPS car to service the EPS call.

According to still additional features, the controller can receive a destination input corresponding to an EPS floor. The controller can authorize a security input to grant a user access to an EPS elevator that will take the user to the desired EPS floor. Authorizing the security input can comprise at least one of, receiving an authorized personal identification number, recognizing biometric data of an individual, and receiving data from an authorized identification card or personal mobile communication device.

According to additional features, the controller determines if a car has a community car status or an isolation car status. The community car status can comprise an ability to combine another EPS call with the particular elevator car. The isolation car status can indicate that the particular elevator car is precluded from being combined with another call.

A method for controlling elevator cars of an elevator system according to additional features of the present disclosure can include receiving an express priority service (EPS) call. The EPS call can indicate a request for priority service wherein priority service comprises an ability to conduct expedited service from an EPS call originating location to an EPS call final destination. The controller can determine whether any active EPS car can service the EPS call. A particular elevator car can be an active EPS car when the particular car is carrying out EPS service. The controller can authorize a security input. When a specific active EPS car can service the EPS call, the controller can assign the specific EPS car to the EPS call. Upon completion of the EPS call, if there are no other EPS or general service calls to service, the controller can reassign the specific EPS car to become a free car.

According to additional features, authorizing a security input to grant access to an EPS elevator car can include at least one of receiving an authorized personal identification number, recognizing biometric data of an individual, and receiving data from an authorized identification card or personal communication device. According to additional features, the controller can determine an estimated time of arrival (ETA) for each active EPS car for the EPS call. The ETA can comprise an estimated time required for an active EPS car to travel from a current location to the EPS call originating location. The controller can compare the ETA to an ETA threshold. When the determined ETA is within the ETA threshold, the controller can assign the EPS car to service the EPS call. According to other features, the controller can determine an estimated time to destination (ETD) for each active EPS car for the EPS call. The ETD can comprise a sum of an estimated overall time required for an active EPS car to travel (i) from a current location to the EPS call originating location and (ii) from the EPS call originating location to the EPS call final destination. The controller can compare the ETD to an ETD threshold. When the determined ETD is within the ETD threshold, the controller can assign the EPS car to service the EPS call.

According to additional features, when no active EPS car can service the EPS call, the controller can determine whether a number of active EPS cars is below a car count threshold. When the number of active EPS cars is below the car count threshold, the controller can assign an additional car to service the EPS call. When the number of active EPS cars is not below the car count threshold, the controller can assign a best available active EPS car to service the EPS call.

A method for controlling elevator cars of an elevator system according to another example of the present disclosure can include assigning free elevator cars of the elevator system to general service or to EPS service. In one embodiment, the controller can receive an EPS call. The EPS call can indicate a request for priority service. Priority service can comprise an ability to conduct expedited service. The controller can determine whether any active EPS car can service the EPS call. A particular elevator car can be an active EPS car when the particular car is carrying out EPS service. The controller can authorize a security input comprising one of a personal identification number, recognizing biometric data of an individual, and receiving data from an authorized identification car or personal mobile communication device. When a specific active EPS car can service the EPS call, control can assign the specific EPS car to the EPS call. Upon completion of the EPS call, if there are no other EPS or general service calls to service, the controller resets the status of the specific EPS car so that it is again designated as a free car. According to other features, the controller can determine an estimated time of arrival (ETA) for each active EPS car for the EPS call. The ETA can comprise an estimated time required for an active EPS car to travel from a current location to the EPS call originating location. Control can compare the determined ETA to an ETA threshold. When the determined ETA is within the ETA threshold, control can service the EPS call. In other features, the controller can determine an estimated time to destination (ETD) for each active EPS car for the EPS call. The ETD can comprise a sum of an estimated overall time required for an active EPS car to travel (i) from a current location to the EPS call originating location and (ii) from the EPS call originating location to the EPS call final destination. The controller can compare the determined ETD to an ETD threshold. When the determined ETD is within the ETD threshold, control can service the EPS call. The security input can comprise one of a community car status and an isolation car status.

BRIEF DESCRIPTION OF THE DRAWINGS

The present disclosure will become more fully understood from the detailed description and the accompanying drawings, wherein.

DETAILED DESCRIPTION

Figure 1:
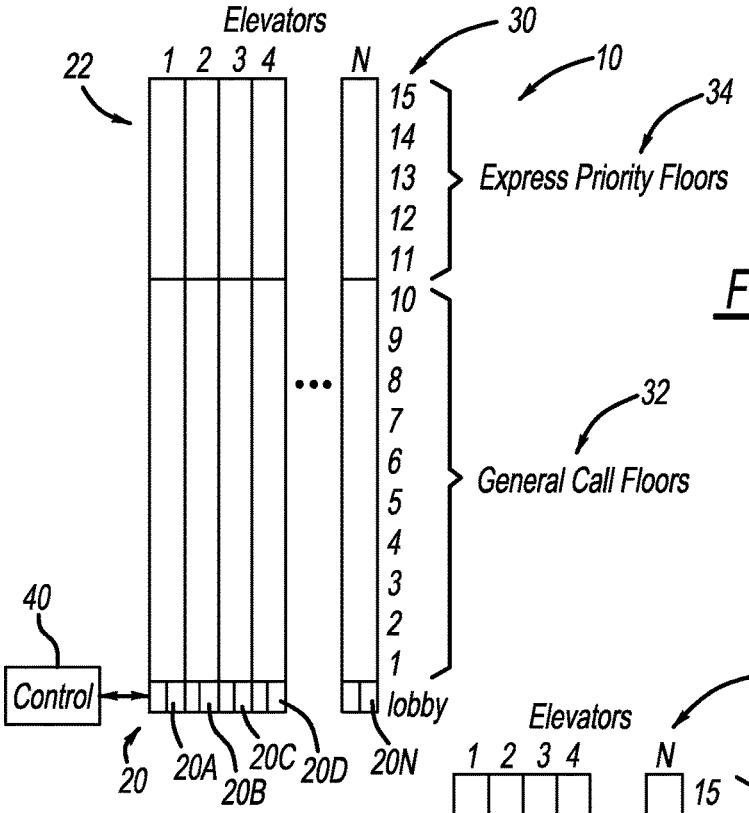
FIG. 1 is a schematic illustration of an exemplary elevator system having express priority floors assigned in accordance to one example of the present disclosure.

With initial reference to FIG. 1, a schematic illustration of an elevator system constructed in accordance to one example of the present teachings is shown and generally identified at reference numeral 10. The elevator system 10 generally includes a plurality of elevators 1-N. According to the example shown, the elevator system 10 includes a plurality of elevator cars collectively identified at reference numeral 20 and individually identified at reference numerals 20A, 20B, 20C, 20D and 20N. Each of the elevator cars 20 operates within a corresponding elevator shaft collectively identified at reference numeral 22. As will be described herein, the elevator cars 20 of the elevator system 10 are configured to service a plurality of floors, collectively identified at reference numeral 30 and identified in the example shown as floors 1-15. It will be appreciated that while 15 floors are shown, a different number of floors may be provided. In the configuration shown in FIG. 1, the floors 30 include a series of general call floors 32 (floors 1-10) and a series of express priority floors 34 (floors 11-15). The elevator system 10 further includes an elevator controller 40 that controls dispatching of the elevator cars 20.

Figure 2:
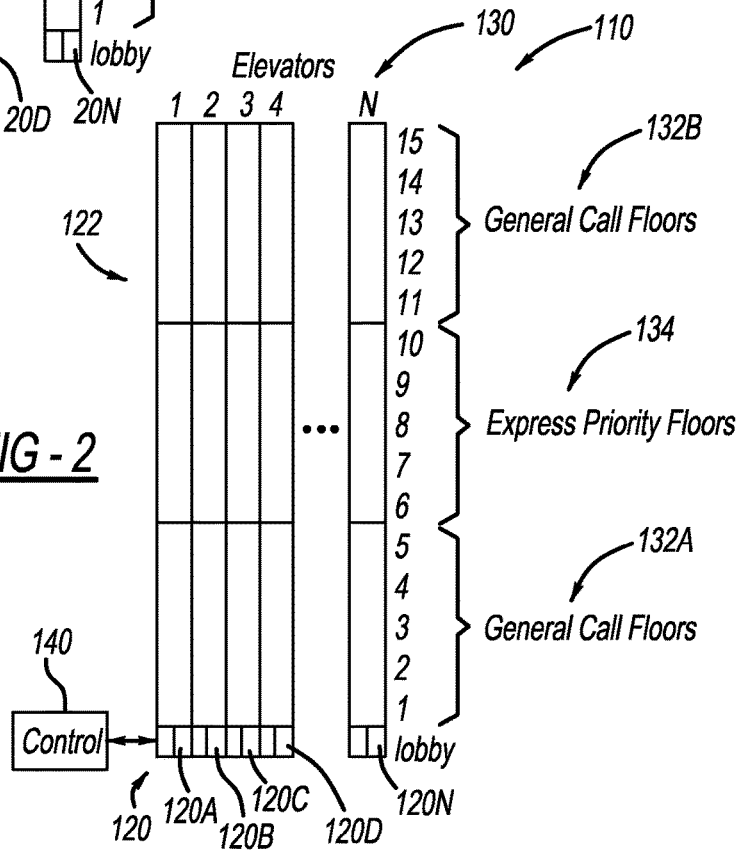
FIG. 2 is a schematic illustration of an exemplary elevator system having express priority floors assigned in accordance to another example of the present disclosure.

FIG. 2 is a schematic illustration of an elevator system 110 constructed in accordance to another example of the present teachings. The elevator system 110 generally includes a plurality of elevators 1-N. According to the example shown, the elevator system 110 includes a plurality of elevator cars collectively identified at reference numeral 120 and individually identified at reference numerals 120A, 120B, 120C, 120D and 120N. Each of the elevator cars 120 operates within a corresponding elevator shaft collectively identified at reference numeral 122. As will be described herein, the elevator cars 120 of the elevator system 110 are configured to service a plurality of floors, collectively identified at reference numeral 130 and identified in the example shown as floors 1-15. Again, the elevator system 110 may have another quantity of floors. In the configuration shown in FIG. 2, the floors 130 include a first series of general call floors 132A (floors 1-5), a second series of general call floors 132B (floors 11-15) and a series of express priority floors 134 (floors 6-10). The elevator system 110 further includes an elevator controller 140 that controls dispatching of the elevator cars 120.

Figure 3:
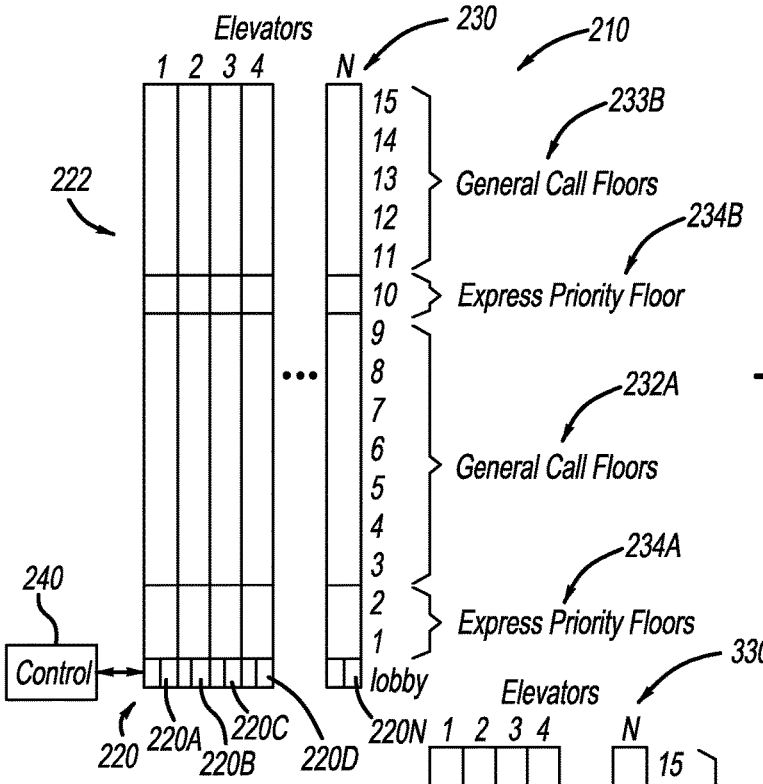
FIG. 3 is a schematic illustration of an exemplary elevator system having express priority floors assigned in accordance to yet another example of the present disclosure.

FIG. 3 is a schematic illustration of an elevator system 210 constructed in accordance to another example of the present teachings. The elevator system 210 generally includes a plurality of elevators 1-N. According to the example shown, the elevator system 210 includes a plurality of elevator cars collectively identified at reference numeral 220 and individually identified at reference numerals 220A, 220B, 220C, 220D and 220N. Each of the elevator cars 220 operates within a corresponding elevator shaft collectively identified at reference numeral 222. As will be described herein, the elevator cars 220 of the elevator system 210 are configured to service a plurality of floors, collectively identified at reference numeral 230 and identified in the example shown as floors 1-15. More or less than 15 floors may be used. In the configuration shown in FIG. 3, the floors 230 include a first series of general call floors 232A (floors 3-9), a second series of general call floors 232B (floors 11-15), a first series of express priority floors 234A (floors 1-2) and a second express priority floor 234B (floor 10). The elevator system 210 further includes an elevator controller 240 that controls dispatching of the elevator cars 220.

Figure 4:
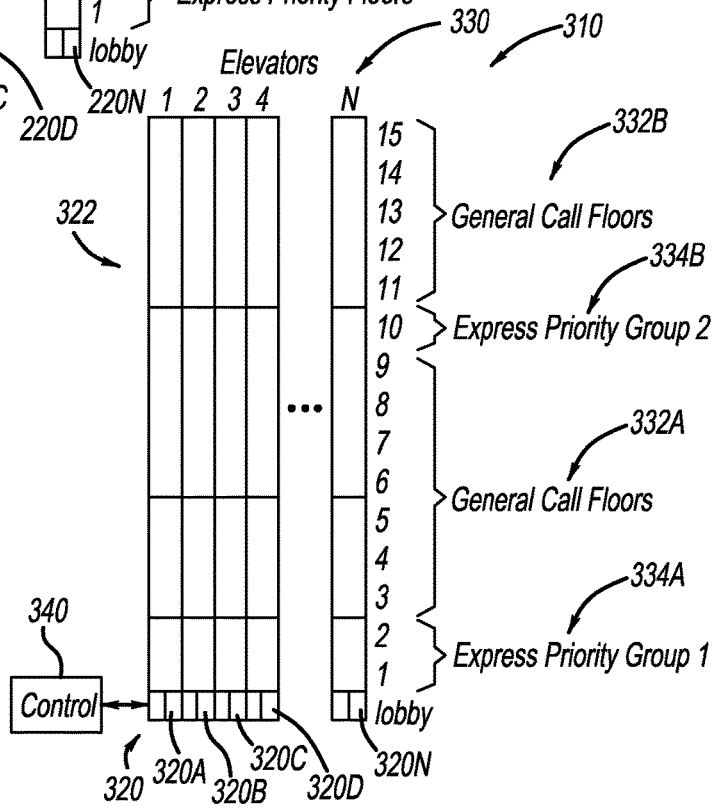
FIG. 4 is a schematic illustration of an exemplary elevator system having express priority floors assigned in accordance to still another example of the present disclosure.

FIG. 4 is a schematic illustration of an elevator system 310 constructed in accordance to another example of the present teachings. The elevator system 310 generally includes a plurality of elevators 1-N. According to the example shown, the elevator system 310 includes a plurality of elevator cars collectively identified at reference numeral 320 and individually identified at reference numerals 320A, 320B, 320C, 320D and 320N. Each of the elevator cars 320 operates within a corresponding elevator shaft collectively identified at reference numeral 322. As will become appreciated herein, the elevator cars 320 of the elevator system 310 are configured to service a plurality of floors, collectively identified at reference numeral 330 and identified in the example shown as floors 1-15. Again, more or less than 15 floors may be used. In the configuration shown in FIG. 4, the floors 330 include a first series of general call floors 332A (floors 3-9), a second series of general call floors 332B (floors 11-15), an express priority group 1, 334A (floors 1-2) and an express priority group 2, 334B (floor 10). The elevator system 310 further includes an elevator controller 340 that controls dispatching of the elevator cars 320.

As described herein, the elevator cars 20, 120, 220 and 320 of the respective elevator systems 10, 110, 210 and 310 include "free cars", "EPS cars" and "general service cars". A free car is an elevator car that is not presently assigned to answer or respond to any particular type of service call, including a general service call or EPS call, and is otherwise available to be called upon for service and may be assigned to any floor of the elevator system. Upon completion of a service call by either an EPS assigned or general service assigned elevator car, if the elevator car does not immediately respond to another service call, it is reset so that it is again designated as a free car awaiting its next service call. An EPS car is an elevator car that is designated to provide a user express priority service to a specific floor, floor zone, one of a subset of identified floors, or tenant on a designated floor whereby the car transports passenger(s) to the designated floor or floors in the zone/group in an expedited manner. In the case of an individual floor, the car travels directly to the desired floor. In the case of a zone or group, the EPS car services just the floors in the zone or floor group. A general service car is an elevator car that services any call that is not an EPS call and otherwise does not provide users any specific express or priority service.

As will become appreciated from the following discussion, EPS designation can be assigned to (i) a location or (ii) a person. In this regard, when EPS designation is used for a location, EPS can be assigned to a floor, a zone or a floor group. An EPS zone or floor group can be multiple EPS floors, either grouped together or separated by other non-EPS floors. An EPS floor can only be serviced by an EPS car assigned to the specific EPS floor. An EPS zone can only be serviced by an EPS car assigned to the specific EPS zone. When EPS designation is used for a person or an individual, EPS can be assigned to an individual rider or tenants sharing floor space with non-EPS designated tenants (floors serviceable by either general cars or EPS cars).

The following discussion will be focused on the elevator system 110 (FIG. 2). The present disclosure provides a method for controlling the elevator cars 120 of the elevator system 110. It will be appreciated however that the methods discussed herein are also applicable to any of the other elevator systems 10, 210 and 310 described above. Further, it will be appreciated that the elevator systems 10, 110, 210 and 310 are merely exemplary. In this regard, the following methods may be applicable to any elevator system having general call floors and express priority floors configured in any manner.

In the present embodiment, general call floors can be serviced by general call elevator cars. Express priority floors can be serviced by express priority service (EPS) cars. In an alternate embodiment, express priority floors can be serviced by EPS cars and general call elevator cars. In yet other embodiments, general call elevator cars can service EPS floors only when EPS is inactive. EPS cars can be configured for expedited service to express priority floors. Expedited service can include non-stop service or service only to express priority floors. It will be appreciated that in some examples a single express priority floor may have multiple express priority designated tenants located thereon. In such a scenario, each express priority tenant can be treated as a unique express priority floor while still occupying a common floor. In alternate embodiments, a single express priority floor may also be included in multiple express priority zones or floor groups comprising one or more floors.

The controller 140 can be any suitable controller or computing device having one or more processors configured to execute at least a portion of the operations described herein. The methods disclosed herein for dispatching the elevator cars 120 incorporate EPS. For the example shown in FIG. 2, EPS is designated for operation on the express priority floors 134 (floors 6-10). In one configuration, when the destination dispatch controller 140 receives an EPS call, the controller 140 assigns an elevator car 120 to transport a passenger directly to the desired EPS floor of the express priority floors 134.

As will become appreciated from the following discussion, the methods according to the present teachings can require all of the elevator cars 120 to be unassigned free cars when not servicing an elevator call. Unassigned free cars have the ability to be assigned to any floor 130 of the elevator system 110. Upon receiving an EPS call, the controller 140 assigns an unassigned free car as an EPS car to service the EPS call. Once the EPS call is completed, the EPS car returns to an unassigned free car status. By selectively assigning an unassigned free car to an EPS car that performs the EPS call and returning that car back to unassigned free car status, traffic flow can be maintained at optimum efficiencies. In this regard, none of the elevator cars 120 are permanently assigned to any floor. Instead, the controller 140 selectively assigns a specific elevator car from the elevator cars 20 to perform general service calls and EPS calls according to various criteria explained herein. Any call received by the controller other than an EPS call is considered to be a general service call.

Figure 5:
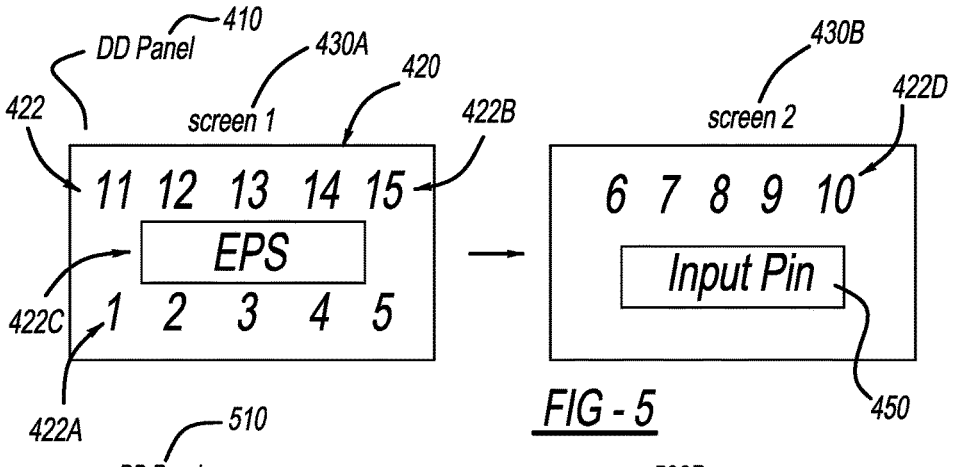
FIG. 5 is a front view of an exemplary destination dispatch panel that displays in sequence a first screen that identifies express priority floors and a second screen that prompts a prospective passenger for a personal identification number.
Figure 6:
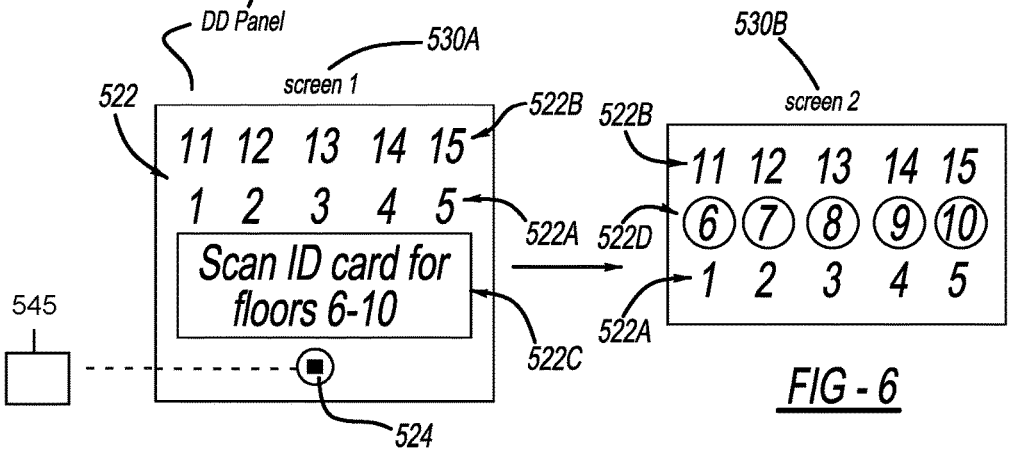
FIG. 6 is a front view of an exemplary destination dispatch panel that displays a screen that identifies express priority floors and prompts a prospective passenger to scan an identification card.
Figure 7:
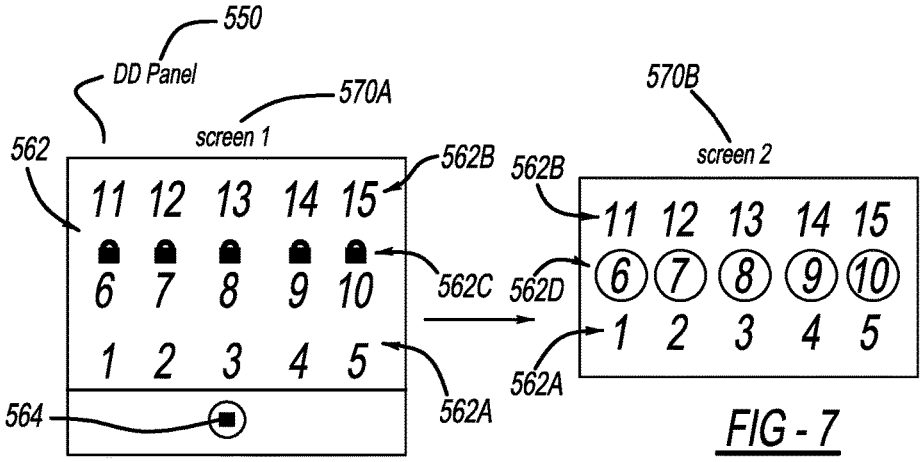
FIG. 7 is a front view of an exemplary destination dispatch panel that displays a screen identifying express priority floors.

Turning now to FIGS. 5-7, various destination displays will be described. A destination display 410 can include a display screen 420 that can be configured as an input interface that displays a series of input options 422. The destination display 410 can be provided in a lobby of a building that includes the elevator system 110. In one configuration, the destination display 410 can be provided at a kiosk located in the lobby of the building. It will be appreciated that while various examples of input interfaces are disclosed herein, other configurations are contemplated. In this regard, while various embodiments of the input interface configuration for the destination displays are disclosed herein, such embodiments are not intended to limit the scope of the configuration of the input displays. Explained further, other configurations and user interfaces permitting input of information into the display and elevator system are contemplated without departing from the scope of the present disclosure.

The destination display 410 can communicate with the controller 140. In the example shown, the input options 422 correspond to the floors 130 (FIG. 2). The input options 422 include a first series of inputs 422A that correspond to the first general call floors 132A (floors 1-5), a second series of inputs 422B that correspond to the second general call floors 132B (floors 11-15) and a third input 422C that corresponds to the express priority floors 134 (floors 6-10). In one example, the destination dispatch panel 410 can be a touch screen that initially displays a first screen 430A. The touch screen receives a user input corresponding to the desired floor destination. In the example shown in FIG. 5, the express priority floors 134 are initially displayed only as "EPS" on the first screen 430A. Once a user, such as a prospective passenger, touches the "EPS" portion of the touch screen, the display screen 420 displays a second screen 430B. In the second screen 430B, the express priority floors 134 (floors 6-10) are displayed as a fourth series of inputs 422D. According to the example shown in FIG. 5, the second screen 430B prompts a user to enter a security input 450. The security input 450 in FIG. 5 requires a pin number to be entered. Once the controller 140 authorizes the security input 450, an EPS car is assigned to the EPS call.

FIG. 6 illustrates another example wherein similar features described above in relation to FIG. 5 are identified by reference numerals increased by 100. A destination display 510 configured according to another example of the present disclosure and shown in FIG. 6 can include a display screen 520 that can be configured to display a series of input options 522. The destination display 510 can further include a sensor 524 that is configured to sense a security device or input 545 such as an identification card in close proximity, a PIN, biometric data, or a mobile device. In one configuration, the identification card can include a radio frequency identification (RFID) tag and the sensor 524 can be an RFID reader. In other examples, the sensor 524 can be a magnetic reader that is configured to slidably receive an identification card having a magnetic strip. Other security devices are contemplated. In the example shown, the input options 522 correspond to the floors 130 (FIG. 2). The input options 522 include a first series of inputs 522A that correspond to the first general call floors 132A (floors 1-5), a second series of inputs 522B that correspond to the second general call floors 132B (floors 11-15) and a third input 522C that corresponds to the express priority floors 134 (floors 6-10). In one example, the destination display 510 can be a touch screen that initially displays a first screen 530A (FIG. 6).

The touch screen receives a user input corresponding to the desired floor destination. In the example shown in FIG. 6, the express priority floors 134 are initially displayed only as "Scan ID card for floors 6-10" on the first screen 530A. If the user wishes to access floors 6-10, they are required to provide authorization such as by placing an identification card in close proximity to the sensor 524, or any of the other configurations described above. Once the security input is authorized by a third party security system, the controller 140, or other similar authorization system, a second screen 530B is displayed. If authorization is not satisfied, the second screen 530B is not displayed. The second screen 530B provides the user with options including a fourth series of inputs 522D corresponding to the express priority floors 134 (floors 6-10). Once a user selects one of the inputs 522D, the controller 140 assigns an EPS car to the EPS call.

FIG. 7 illustrates another example wherein similar features described above in relation to FIG. 6 are identified by reference numerals increased by 40. FIG. 7 illustrates an example where the express priority floors 134 are initially displayed together with a lock icon on the first screen 570A. If a user wishes to access floors 6-10, they are required to provide authorization such as by placing an identification card in close proximity to the sensor 564, or any of the other configurations described above. Once the security input is authorized by a third party security system, the controller 140, or other similar authorization system, a second screen 570B is displayed. If authorization is not satisfied, the second screen 530B is not displayed. The second screen 570B provides the user with options including a fourth series of inputs 562D corresponding to the express priority floors 134 (Floors 6-10). Once a user selects one of the inputs 522D, the controller 140 assigns an EPS car to the EPS call.

In other examples, the destination displays 410, 510 and 550 can be configured to operate in conjunction with a mobile device such as a mobile phone. In this regard, the various screens 430A, 430B, 530A, 530B, 570A and 570B may be additionally or alternatively displayed for use on a prospective passenger's mobile device. In such examples, the controller 110 can additionally or alternatively receive inputs from a mobile device.

Figure 8A:
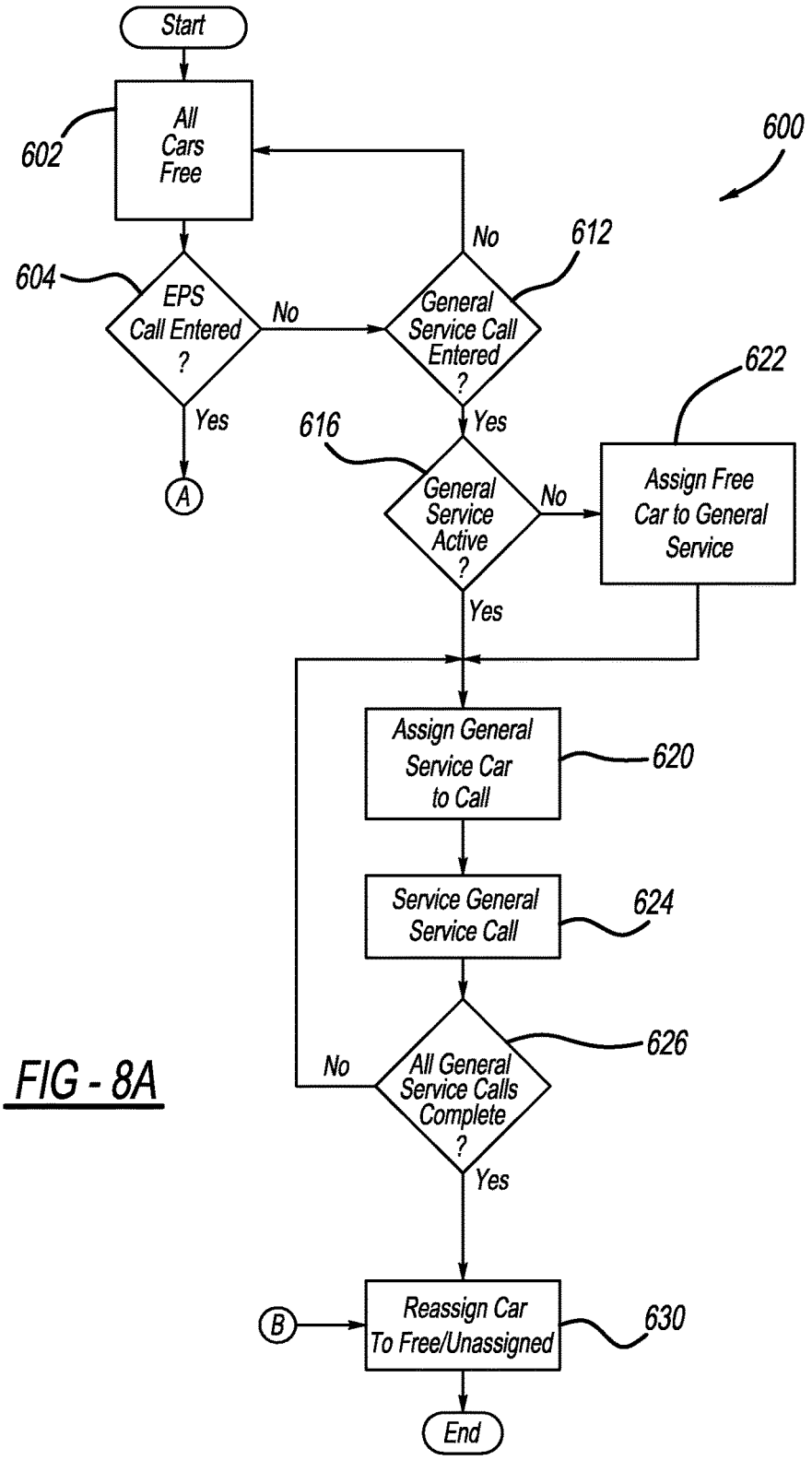
FIGS. 8A and 8B show an exemplary method for controlling elevator cars of the elevator system according to one example of the present disclosure.
Figure 8B:
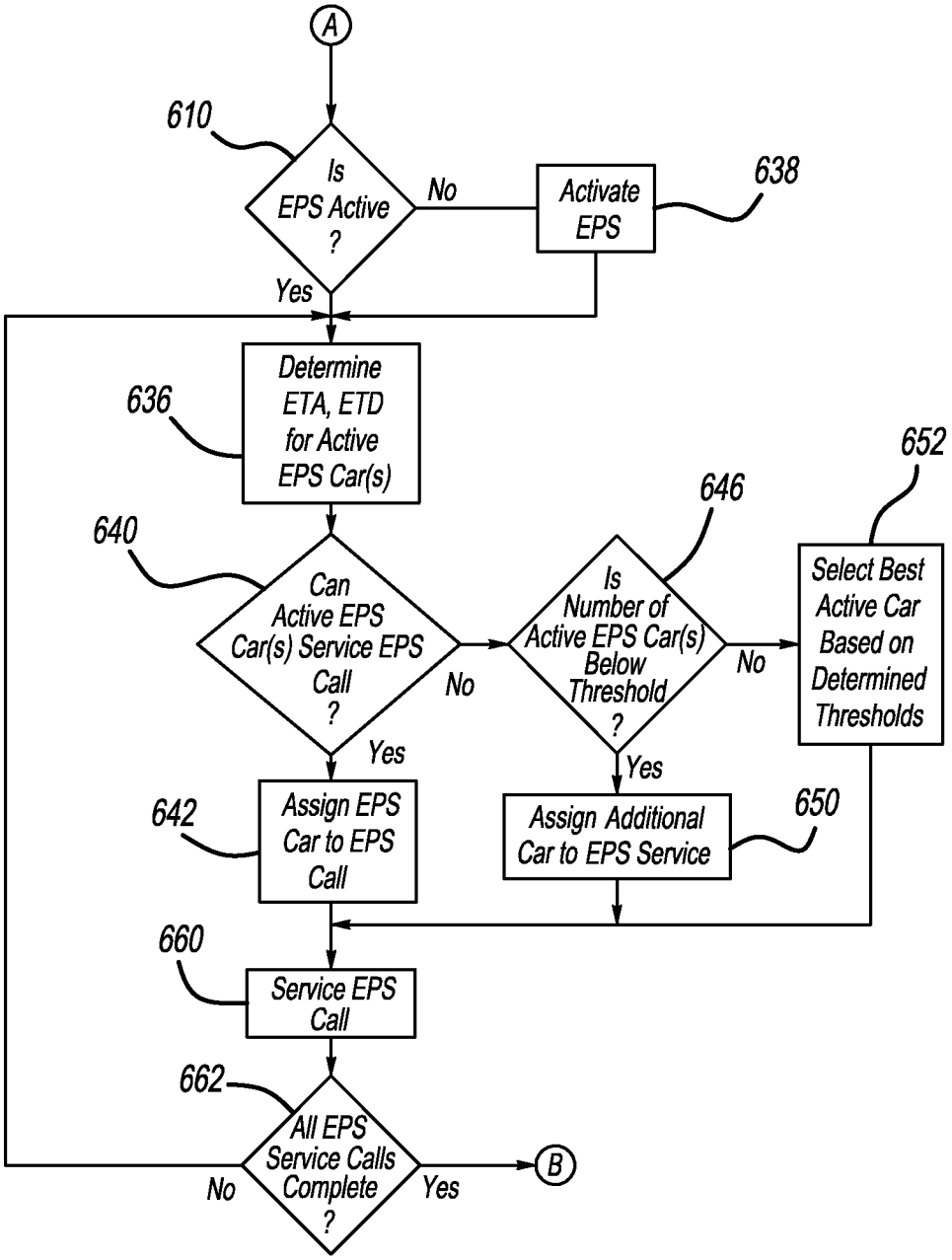

With reference now to FIGS. 8A and 8B, a method for controlling elevator cars 130 of the elevator system 110 according to one example of the present disclosure is shown and generally identified at reference numeral 600. At 602 the controller 140 assigns all cars as free cars. At 604, the controller 140 determines whether an EPS call has been received. An EPS call indicates a request for priority service. If an EPS call has not been received, the controller 140 determines whether a general service call has been received at 612. If not, the controller 140 loops to 602. If a general service call has been received, the controller 140 determines whether general service is active at 616. If general service is active, the controller 140 assigns a general service car to service the call at 620. If general service is not active, the controller 140 assigns a free car to general service at 622. At 624, the general service call is serviced. At 626 the controller 140 determines whether all general service calls are complete. If not, the controller 140 loops to 620. If all general service calls are complete, the car is reassigned to free (unassigned) status at 630.

If an EPS call has been received at 604, the controller 140 determines if EPS is active at 610 (FIG. 8B). If EPS is not active, the controller 140 activates EPS at 638. The controller 140 then proceeds to 636. If EPS is active, the controller 140 determines a timing requirement for each active EPS car at 636. In one example, the timing requirement can be an estimated time of arrival (ETA). The ETA is an estimated time required for an active EPS car to travel from a current location to the EPS call originating location (or the present location of the prospective passenger). In another example, the timing requirement can be an estimated time to destination (ETD) for each active EPS car. The ETD is a sum of an estimated overall time required for an active EPS car to travel (i) from a current location to the EPS call originating location and (ii) from the EPS call originating location to the EPS call final destination. The EPS call final destination can be the requested destination selected by the prospective passenger. In yet another example, the timing requirement can be an estimated time from when elevator doors open to pick up the prospective passenger to the moment the prospective passenger arrives at the EPS call final destination. It will be appreciated that the timing requirements and thresholds may be determined and affected by other variables within the scope of the present disclosure.

In 640, the controller 140 determines whether an active EPS car can service the EPS call. In one example, the controller 140 compares at least one of the determined ETA to an ETA threshold and the determined ETD to an ETD threshold for each active EPS car. When at least one of the ETA and ETD is within the respective ETA and ETD threshold for a specific car, the controller 140 assigns an EPS car to the EPS call at 642 and services the EPS call at 660 with the specific active EPS car. In other examples, the controller 140 can service the EPS call with a specific active EPS car if both of the ETA and ETD are within the respective ETA and ETD thresholds.

In one example, the controller 140 receives a destination input corresponding to an EPS floor and authorizes a security input to grant access to an EPS elevator car in 640. The security input can include authorizing a personal identification number (see also FIGS. 5-7), recognizing biometric data of an individual and receiving data from an authorized identification card, personal communication device or any other security protocol. Biometric data includes, but is not limited to, a fingerprint scan, a retinal scan, voice recognition, facial recognition and other characteristics associated with the prospective user.

In some examples, the controller 140 can also determine if a car has a community car preference or an isolation car preference. A community car preference can comprise the ability to combine elevator calls. An isolation car preference can comprise an indication that a particular elevator car is precluded from being combined with other elevator calls. In this regard, an EPS call can be serviced with any active elevator car having a community car preference and not an isolation car preference. In one configuration, all EPS calls may be community calls. In other examples, all EPS calls may be isolation calls. In still other configurations, calls may be split between community calls and isolation calls. The community car or isolation car preference may be (but is not required to be) accessed at the time the security authorization is determined. The community and isolation car preference can be assigned to a user, a floor, a zone or a specific tenant. The preference can be established by security credentials or determined by the controller and can be temporary or permanent. The preference can be stored in a user profile on the elevator system, stored on a security identification card or other security access key fob. In one example, a certain individual, such as a VIP may have an isolation preference in their profile that allows that person to ride alone.

When the community car preference is assigned to an EPS floor, zone or floor group, all calls to the same floor or zone are combined so all riders occupy the same EPS car. When the isolation car preference is assigned to an EPS floor or zone, no other calls can be assigned to the EPS car. When the community car preference is assigned to individual riders designated with EPS access, all EPS calls to a particular floor can be combined into that EPS car. When the community car preference is assigned to individual riders, all calls (including general service calls) going to an EPS passenger's selected floor are combined into that passenger's EPS car. When the isolation car preference is assigned to an individual rider designated with EPS access, no other calls can be assigned to that rider's EPS car. When the community car preference is assigned to tenants sharing floor space with non-EPS designated tenants, all calls (including general service calls) to the tenant's floor are combined into the same EPS car going to the tenant. When the isolation car preference is assigned by a passenger, the passenger rides alone to the tenant floor on the EPS car. When the isolation car preference is assigned by a tenant, all EPS calls to the same tenant floor are combined in the same EPS car. General calls to the same floor as an EPS tenant are serviced by a general car rather than by an EPS car.

It will be appreciated that in some configurations, the controller 140 may not require a security input. In this regard, the elevator system 110 may be configured to assign an EPS car without requiring a prospective passenger to provide a security input. A general call to a specific EPS floor may be assigned to an EPS elevator as long as the EPS car already had an EPS call to the specific EPS floor assigned to it. Such a scenario can be useful when an EPS car has been assigned to service an EPS call for a first passenger, and before the EPS car arrives to pick up the first passenger, a second prospective passenger desires to travel to the same floor as the first passenger. The controller will not require a security input from the second prospective passenger and will instead assign the second prospective passenger to the EPS car already assigned to service the first passenger.

If the controller 140 determines that an active EPS car can service the EPS call in 640, an EPS car is assigned to the EPS call in 642 and the EPS call is serviced in 660. If the controller 140 determines that an active EPS car cannot service the EPS call, the controller 140 determines whether the number of active EPS cars is below a car count threshold at 646. The car count threshold can be set at any value such as 2 cars or 3 cars. Additionally or alternatively the car count threshold can be a percent of the total amount of active cars such as 25% for example. If the controller 140 determines that the number of active EPS cars is below a threshold, an additional car is assigned to EPS service in 650 and the controller 140 loops to 660 to service the EPS call. If the controller 140 determines that the number of active EPS cars is not below a threshold, the best active car is selected in 652. In one example, the best active car can be selected from the active EPS cars such as by comparing the respective ETA's and/or ETD's for all active EPS cars and selecting the best one. In other examples, the best active car can be selected from the general service cars. According to still another example, the controller 140 can forgo 652 and simply loop to 636 and wait until an active EPS car can service the EPS call within at least one of the ETA and ETD thresholds.

The controller 140 determines whether all EPS service calls have been completed in 662. If all of the EPS service calls have not been completed, the controller 140 loops to 636. If the controller 140 determines that all EPS calls have been completed, the EPS car is reassigned to free car status at 630 (FIG. 8A). Explained differently, the EPS car is unassigned and becomes a free car.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. In this regard, the ordering of method steps is not necessarily fixed, but may be capable of being modified without departing from the instant teachings. Such variations are not to be regarded as a departure from the disclosure, and all such modifications are intended to be included within the scope of the disclosure.

What is claimed is:

1. A method for controlling elevator cars of an elevator system, the method comprising:

selectively assigning free elevator cars of the elevator system to one of general service and express priority service (EPS);

receiving an express priority service (EPS) call, wherein the EPS call indicates a request for priority service from an EPS call originating location to an EPS call final destination;

determining whether any active EPS car can service the EPS call;

when a specific active EPS car can service the EPS call, assigning the specific EPS car to the EPS call; and upon completion of the EPS call, unassigning the specific EPS car so that the specific EPS car becomes a free car, wherein determining whether any active EPS car can service the EPS call comprises:

determining an estimated time to destination (ETD) for each active EPS car for the EPS call, the ETD comprising a sum of an estimated overall time required for an active EPS car to travel (i) from a current location to the EPS call originating location and (ii) from the EPS call originating location to the EPS call final destination;

comparing the ETD to an ETD threshold for each active EPS car; and when the determined ETD for a given active EPS car is within the ETD threshold, assigning the given active EPS car to service the EPS call.

2. The method of claim 1 wherein determining whether any active EPS car can service the EPS call further comprises:

determining an estimated time of arrival (ETA) for each active EPS car for the EPS call, the ETA comprising an estimated time required for an active EPS car to travel from a current location to the EPS call originating location;

comparing the determined ETA for each active EPS car to an ETA threshold; and when the determined ETA for a given active EPS car is within the ETA threshold, assigning the given active EPS car to service the EPS call.

3. The method of claim 1 wherein when no active EPS car can service the EPS call:

determining whether a number of active EPS cars is below a car count threshold; and when the number of active EPS cars is below the car count threshold, assigning an additional car to service the EPS call.

4. The method of claim 1 wherein when the number of active EPS cars is not below the car count threshold, assigning a best available active EPS car to service the EPS call.

5. The method of claim 1 wherein determining whether any active EPS car can service the EPS call comprises:

receiving a destination input corresponding to an EPS floor; and authorizing a security input.

6. The method of claim 5 wherein authorizing a security input comprises at least one of:

receiving an authorized personal identification number;

receiving data from an authorized identification card or personal mobile communication device; and recognizing biometric data.

7. The method of claim 1, further comprising:

determining one of a community car and isolation car preference where the community car preference comprises an ability to combine elevator car calls, the isolation car preference precluding elevator calls from being combined.

8. The method of claim 7, further comprising:

servicing first and second elevator calls together with any elevator car having the community car preference.

9. A method for controlling elevator cars of an elevator system, the method comprising:

receiving an express priority service (EPS) call, wherein the EPS call indicates a request for priority service wherein priority service comprises an ability to conduct expedited service from an EPS call originating location to an EPS call final destination;

determining whether any active EPS car can service the EPS call, a particular elevator car being an active EPS car when the particular car is carrying out EPS service;

authorizing a security input;

when a specific active EPS car can service the EPS call, assigning the specific EPS car to the EPS call; and upon completion of the EPS call, unassigning the specific EPS car so that the specific EPS car becomes a free car, wherein determining whether any active EPS car can service the EPS call comprises:

determining an estimated time to destination (ETD) for each active EPS car for the EPS call, the ETD comprising a sum of an estimated overall time required for an active EPS car to travel (i) from a current location to the EPS call originating location and (ii) from the EPS call originating location to the EPS call final destination;

comparing the ETD to an ETD threshold for each active EPS car; and when the determined ETD for a given active EPS car is within the ETD threshold, assigning the given active EPS car to service the EPS call.

10. The method of claim 9 wherein authorizing a security input comprises at least one of:

receiving an authorized personal identification number;

receiving data from an authorized identification card or personal mobile communication device; and recognizing biometric data.

11. The method of claim 9, further comprising:

determining one of a community car and isolation car preference where the community car preference comprises an ability to combine elevator car calls, the isolation car preference precluding elevator calls from being combined.

12. The method of claim 9 wherein determining whether any active EPS car can service the EPS call further comprises:

determining an estimated time of arrival (ETA) for each active EPS car for the EPS call, the ETA comprising an estimated time required for an active EPS car to travel from a current location to the EPS call originating location;

comparing the determined ETA for each active EPS car to an ETA threshold; and when the determined ETA for a given active EPS car is within the ETA threshold, assigning the given active EPS car to service the EPS call.

13. The method of claim 9 wherein when no active EPS car can service the EPS call:

determining whether a number of active EPS cars is below a car count threshold; and when the number of active EPS cars is below the car count threshold, assigning an additional car to service the EPS call.

14. The method of claim 13 wherein when the number of active EPS cars is not below the car count threshold, assigning a best available active EPS car to service the EPS call.

15. A method for controlling elevator cars of an elevator system, the method comprising:

selectively assigning free elevator cars of the elevator system to one of general service and express priority service (EPS);

receiving an express priority service (EPS) call, wherein the EPS call indicates a request for priority service wherein priority service comprises an ability to conduct expedited service;

determining whether any active EPS car can service the EPS call;

authorizing a security input comprising at least one of (i) receiving a personal identification number, (ii) receiving data from an authorized identification card, (iii) receiving data from a personal communication device, and (iv) recognizing biometric data;

when a specific active EPS car can service the EPS call, assigning the specific EPS car to the EPS call; and upon completion of the EPS call, unassigning the specific EPS car so that the specific EPS car becomes a free car, wherein determining whether any active EPS car can service the EPS call comprises:

determining an estimated time to destination (ETD) for each active EPS car for the EPS call, the ETD comprising a sum of an estimated overall time required for an active EPS car to travel (i) from a current location to the EPS call originating location and (ii) from the EPS call originating location to the EPS call final destination;

comparing the ETD to an ETD threshold for each active EPS car; and when the determined ETD for a given active EPS car is within the ETD threshold, assigning the given active EPS car to service the EPS call.

16. The method of claim 15 wherein determining whether any active EPS car can service the EPS call further comprises:

determining an estimated time of arrival (ETA) for each active EPS car for the EPS call, the ETA comprising an estimated time required for an active EPS car to travel from a current location to the EPS call originating location;

comparing the determined ETA for each active EPS car to an ETA threshold; and when the determined ETA for a given active EPS car is within the ETA threshold, assigning the given active EPS car to service the EPS call.

17. The method of claim 15, further comprising:

determining one of a community car and isolation car preference where the community car preference comprises an ability to combine elevator car calls, the isolation car preference precluding elevator calls from being combined; and servicing first and second elevator calls together with any elevator car having the community car preference.

* * * * *